US007182072B1

(12) United States Patent
Clemens

(10) Patent No.: US 7,182,072 B1
(45) Date of Patent: Feb. 27, 2007

(54) PURGE FUEL VAPOR CONTROL

(75) Inventor: David Clemens, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/223,306

(22) Filed: Sep. 9, 2005

(51) Int. Cl.
*F02M 33/02* (2006.01)
*F02M 33/04* (2006.01)

(52) U.S. Cl. ..... 123/520; 123/519

(58) Field of Classification Search ..... 123/516, 123/517, 518, 519, 520, 698, 198 D
See application file for complete search history.

(56) References Cited

U.S. PATENT DOCUMENTS 5,072,712 A 12/1991 Steinbrenner et al.
5,263,460 A 11/1993 Baxter et al.
5,273,018 A 12/1993 Suzuki
5,429,098 A 7/1995 Tomisawa
5,634,451 A 6/1997 Tomisawa
5,649,687 A * 7/1997 Rosas et al. ..... 251/129.15
5,682,863 A 11/1997 Kadooka
6,578,564 B2 * 6/2003 Bagnasco ..... 123/698

* cited by examiner

*Primary Examiner*—Mahmoud Gimie
(74) *Attorney, Agent, or Firm*—Allan J. Lippa; Alleman Hall McCoy Russel & Tuttle LLP

(57) ABSTRACT

A system and method for controlling the introduction of purge fuel vapor into a multi-cylinder internal combustion engine is provided. According to one aspect of the disclosure, a schedule for opening and closing an on-off, pulse-width-modulated, purge control valve is predetermined, and the purge control valve is opened and closed according to the predetermined schedule. According to one aspect of the disclosure, a predetermined schedule can include a repeating sequence of on-pulse frequencies.

23 Claims, 4 Drawing Sheets

PURGE FUEL VAPOR CONTROL

FIELD

The present disclosure is directed toward a system and method for controlling the introduction of purge fuel vapor into a multi-cylinder internal combustion engine.

BACKGROUND AND SUMMARY

Many multi-cylinder internal combustion engines include an evaporative fuel recovery system, in which fuel vapors vented from the fuel tank and captured in a carbon canister are drawn into the engine, where they are combusted along with fuel delivered by fuel injectors. Such systems can include a purge control valve, which controls the flow rate of canister purge fuel vapors entering the engine. Some purge control valves are on-off, pulse-width modulated valves, which are designed to be either fully open or fully closed. Pulse-width modulated valves can be driven by an electrical input signal which is high for a fraction of the signal period and low for the remainder of the signal period. The high portion of the signal is called the on-pulse. The valve opens to allow purge fuel vapors to enter the engine during the on-pulse and closes for the remainder of the signal period. The frequency and duration of the on-pulse determines the average flow rate through the valve.

If the purge control valve input signal frequency is kept at a constant value, there will be an engine speed, called the critical rpm value, at which the on-pulses align in time with the intake stroke of the same engine cylinder for many consecutive intake strokes. Such a situation can cause that particular cylinder to receive most of the purge fuel, while the other cylinders receive substantially less purge fuel. This is undesirable, because it can result in an excessively rich air to fuel ratio in one particular cylinder.

U.S. Pat. No. 5,682,863 (the '863 patent) proposes one approach for preventing the on-pulse of the purge control valve from aligning in time with the intake stroke of a particular cylinder. In particular, according to the '863 patent, the frequency of the purge control valve is continuously adjusted in response to changing engine speeds to avoid such alignments. The frequency of the purge control valve for a given engine speed is adjusted, during engine operation, so as to prevent the on-pulse of the purge control from aligning in time with the intake stroke of any particular cylinder. When engine speed changes, the frequency of the purge control valve is adjusted to avoid alignment at the new engine speed. This process occurs over and over again, during engine operation, because the engine speed repeatedly changes.

U.S. Pat. No. 5,429,098 (the '098 patent) also proposes changing the on-pulse frequency in response to changing engine speed. The '098 patent also proposes another approach for preventing the on-pulse of the purge control valve from aligning in time with the intake stroke of a particular cylinder. In particular, the '098 patent teaches changing the on-pulse frequency based on an elapsed time, which is measured with a timer. Using this process, the elapsed time is constantly monitored, and an on-pulse frequency that corresponds to a particular elapsed time is selected over and over again, during engine operation.

The inventor herein has recognized that the approaches disclosed in the '863 patent and the '098 patent have several issues. In particular, the '863 patent requires the purge control valve to change frequency, during engine operation, in response to changes in engine speed, and the '098 patent requires the purge control valve to change frequency, during engine operation, in response to changes in either engine speed or a measured elapsed time. Such approaches require the engine speed and/or an elapsed time to be monitored during engine operation. Furthermore, the '863 patent and the '098 patent require synchronization with engine cylinder events. Degradation in monitoring engine speed, monitoring an elapsed time, and/or synchronizing with engine cylinder events can cause the approaches of the '863 patent and the '098 patent to give erroneous results.

At least some of the above issues may be addressed by a system and method for changing purge valve on-pulse period (frequency) according to a predetermined schedule without monitoring engine speed, an elapsed time, or other real-time operating parameters of the engine. In this way, it may be possible to limit alignment between the on-pulse of a purge control valve and consecutive intake strokes of a particular cylinder without requiring synchronization with engine cylinder events, and/or real-time monitoring of engine speed, elapsed time, or other operating parameters of the engine.

DETAILED DESCRIPTION

Figure 1:
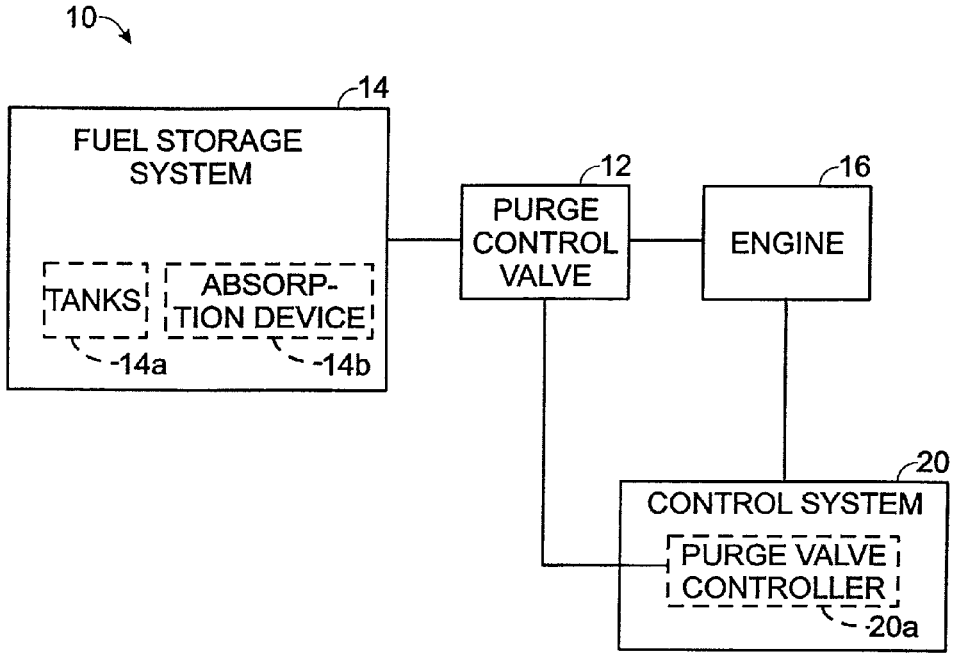
FIG. 1 is a schematic diagram of a fuel delivery system including a pulse-width-modulated purge control valve.

The present disclosure relates to the control of pulse-width-modulated valves, such a purge control valve used with an internal combustion engine. FIG. 1 schematically shows a purge fuel delivery system 10, which includes a pulse-width-modulated valve in the form of a purge control valve 12. Purge control valve 12 is operatively interposed between a fuel storage system 14 and an internal combustion engine 16.

The fuel storage system can include one or more tanks 14*a* configured to hold liquid fuel and one or more absorption devices 14*b* configured to at least temporarily hold evaporated fuel. The purge control valve can be used to at least partially control a flow rate of air flowing through absorption devices 14*b* and into the engine, purging the stored fuel out of the absorption device while the engine is running. The purge air/fuel mixture which exits from the absorption device can flow through the purge control valve and then into the intake manifold of the engine. The purge air/fuel mixture can then enter the engine cylinders, where it can be combusted along with fuel delivered by fuel injectors.

Engine 16 can take a variety of different forms in different embodiments. Nonlimiting examples include 4, 6, 8, 10, and 12 cylinder engines that include electronically controlled fuel injection systems.

A control system 20 can be operatively coupled to at least purge control valve 12 and engine 16. The control system can be configured to control a variety of different engine functions, such as fuel injection. The control system can include a purge valve controller 20*a* that delivers a pulse-width-modulated signal to purge control valve 12, thus causing the purge control valve to open and close. The present disclosure describes in detail the manner in which a purge valve controller can regulate the opening and closing of the purge control valve according to an open and close schedule.

Figure 2:
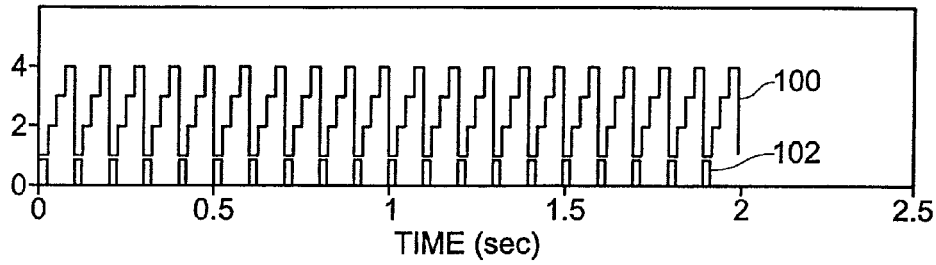
FIG. 2 is a timing chart showing a purge control valve opening at 10 Hz in relation to intake stroke timing in a four cylinder engine operating at 1200 rpm.

FIG. 2 shows intake stroke timing 100 in an exemplary four cylinder engine operating at 1200 rpm. FIG. 2 also shows a purge valve input signal 102 having a duty cycle of 25% and a signal frequency of 10 Hz. Under such operating conditions, the on-pulse aligns exactly with every intake stroke of cylinder 1, because 1200 rpm is the critical rpm value for a purge valve input signal frequency of 10 Hz. Such an operating condition results in a disproportionate amount of the purge fuel going into one particular cylinder. If the valve signal frequency or the engine speed shift slightly away from these values, the on-pulse alignment can shift to a different cylinder for some amount of time, and, in some circumstances, can become shared by two cylinders.

Figure 3:
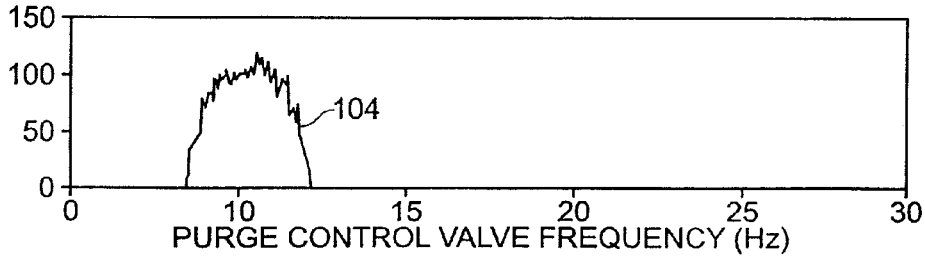
FIG. 3 shows an estimated relative alignment, at different purge control valve frequencies, between consecutive intake strokes of a cylinder in a four cylinder engine operating at 1200 rpm and the opening of a purge control valve.
Figure 4:
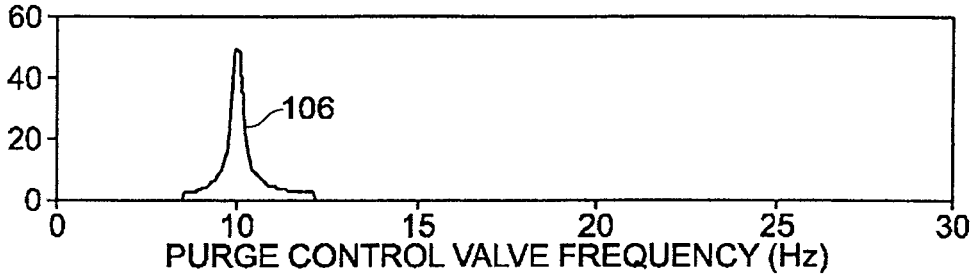
FIG. 4 shows the number of consecutive same-cylinder alignments found during a 5 second simulation run when a purge control valve opens at different frequencies and a four cylinder engine is operated around 1200 rpm.
Figure 5:
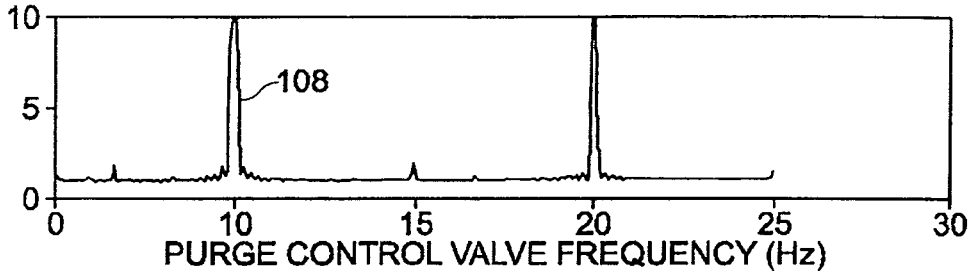
FIG. 5 shows an estimated ratio of the amount of purge fuel vapor, at different purge control valve frequencies, received by the cylinder receiving the most purge fuel vapor as compared to the amount of purge fuel vapor received by the cylinder receiving the least purge fuel vapor in a four cylinder engine operating at 1200 rpm.
Figure 6:
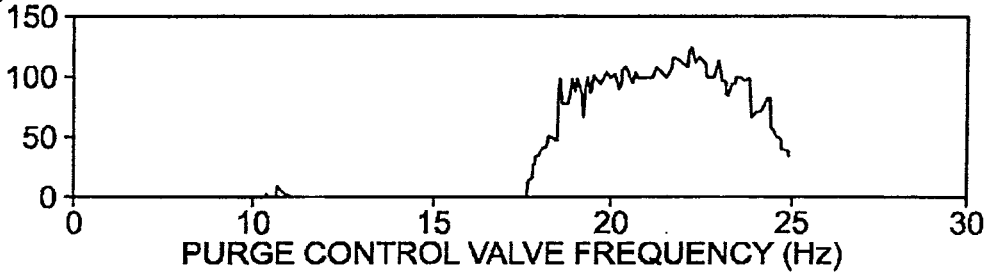
FIG. 6 shows an estimated relative alignment, at different purge control valve frequencies, between consecutive intake strokes of a cylinder in a four cylinder engine operating at 2500 rpm and the opening of a purge control valve.
Figure 7:
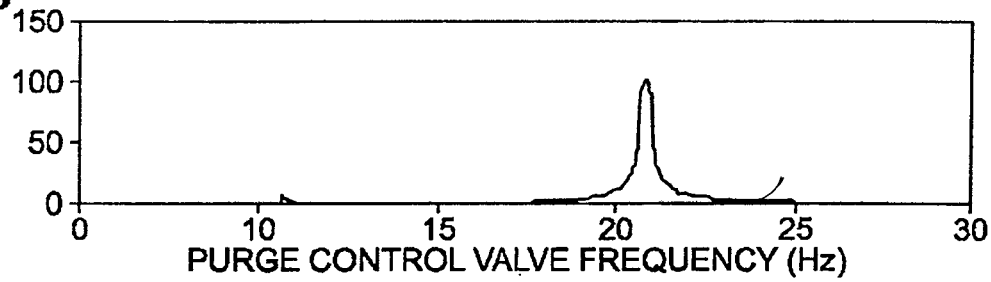
FIG. 7 shows the number of consecutive same-cylinder alignments found during a 5 second simulation run when a purge control valve opens at different frequencies and a four cylinder engine is operated around 2500 rpm.
Figure 8:
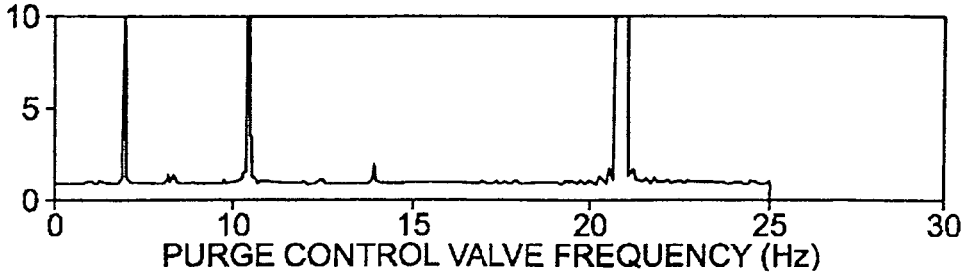
FIG. 8 shows an estimated ratio of the amount of purge fuel vapor, at different purge control valve frequencies, received by the cylinder receiving the most purge fuel vapor as compared to the amount of purge fuel vapor received by the cylinder receiving the least purge fuel vapor in a four cylinder engine operating at 2500 rpm.

In a four cylinder engine operating at a given constant rpm, the purge valve frequency that will align with the intake strokes of a particular cylinder can be computed as engine speed (rpm)/120. However, other frequencies that are near this frequency can also cause a particular cylinder to receive a relatively high proportion of purge fuel vapor. FIGS. 3–5 demonstrate this concept in an exemplary four cylinder engine operating at 1200 rpm. FIG. 3 plots an estimated relative alignment rating 104 versus purge valve input frequency, where a higher alignment rating corresponds to a higher percent of valve on-pulses that at least substantially align with consecutive intake strokes of the same cylinder. The highest alignment rating occurs around a 10 Hz input valve frequency. FIG. 4 shows the number 106 of same-cylinder consecutive alignments found during a 5 second simulation run of a model. Again, it can be seen that for a four cylinder engine operating at 1200 rpm, the greatest number of consecutive alignments will occur when the purge control valve is operating at 10 Hz. FIG. 5 shows an estimated ratio 108 of the amount of purge fuel vapor received by the cylinder receiving the most purge fuel vapor as compared to the amount of purge fuel vapor received by the cylinder receiving the least purge fuel vapor. This ratio is highest at about 10 Hz, with another significant spike occurring at 20 Hz, and minor spikes occurring at 5 Hz, 15 Hz, and 25 Hz. At all other frequencies, the estimated ratio is substantially flat at about 1:1. FIGS. 6–8 show the same information as FIGS. 3–5, but for an exemplary four cylinder engine operating at 2500 rpm.

As can be seen in FIGS. 3–8, for any given engine speed, there is typically one primary band of purge control valve frequencies at which one particular cylinder will receive substantially more purge fuel vapor than other cylinders, due to consecutive alignments of the purge valve on-pulses with the intake strokes of this particular cylinder. This critical frequency band generally has a width less than +/−4 Hz. Changing the purge control valve frequency by a relatively large amount after each valve signal period ends can stop the purge control valve from aligning with consecutive intake strokes of a particular cylinder, thus preventing a particular cylinder from receiving substantially more purge fuel vapor than other cylinders. The purge control valve signal frequency can be continuously changed in this manner so that the valve signal frequency does not stay in a critical band for more than one signal period, thus limiting any consecutive alignments of the purge valve on-pulses with intake strokes of a particular cylinder.

As used herein, the term "period" is used to describe a time beginning with an on-pulse and ending immediately before the next on-pulse. The "frequency" during that period equals 1/period and represents the number of on-pulses that would occur in one second if the signal period actually remained constant for one full second. It should be understood that in some embodiments, the frequency of the purge control valve can be changed so that the purge control valve will not have the same length period for any two consecutive periods. In other words, a purge control valve can be controlled so that the frequency of each on-pulse is different from the frequency of the preceding on-pulse and the following on-pulse. Describing one particular on-pulse as having a given frequency is not meant to imply that any other on-pulse will have the same frequency and/or period.

The magnitude and timing of changes made to the frequency of a purge control valve on-pulse can be predetermined. The magnitude and timing need not be decided during engine operation in response to a measured engine speed, elapsed time, and/or other real-time parameter. The changes in frequency can be fixed so as to limit a particular cylinder from receiving substantially more purge fuel vapor than another cylinder, irrespective of the engine's pattern of operation (e.g., engine speed during a particular period of operation, measured elapsed time, etc.). In other words, the control strategy disclosed herein, which, in some embodiments, can be predetermined and fixed before engine operation begins, can be effective throughout a wide range of engine operating patterns (e.g., changing engine speeds, elapsed times, etc.), and therefore the control strategy, including calculated frequencies for the purge control valve, need not be changed during engine operation in order to respond to a particular engine speed (or other operating parameter of the engine).

In general, it has been found that by changing the frequency by a relatively large amount after a valve signal period ends, the alignment problem described above can be limited, if not eliminated altogether. Such changes can be made by a predetermined amount that can be fixed before engine operation begins. In some nonlimiting embodiments, the valve signal period can be changed by a relatively large amount each time that the last valve signal period ends. For example, the frequency can be changed by +/−3.75 Hz or more, although this is not required in all embodiments. In some embodiments, the magnitude of a frequency change after one valve signal period ends can be different than the magnitude of a frequency change after a different valve signal period ends. In some embodiments, the valve signal period can be changed so as not to come close to the same value for at least two signal periods. In some embodiments, a repeating sequence of frequencies (e.g., 5, 14, 20, 8.75, 12.5, 5, 14, 20, 8.75, 12.5, etc.) can be predetermined.

As described above, changes to the frequency of a purge control valve's on-pulse can be predetermined, and therefore need not be responsive to engine operating patterns (e.g., engine speed). However, predetermining the frequencies is not required. In some embodiments, a randomized pattern, which can be calculated during engine operation, can be used. In this manner, the frequency of a purge control valve's on-pulse can be changed by a random amount with every on-pulse cycle. A randomized control strategy can be constrained by one or more rules. In other words, a frequency change can randomly be selected within bounds established by one or more rules. Nonlimiting examples of such rules could constrain a frequency to be 1) between a minimum frequency (e.g., 4 Hz) and maximum frequency (e.g., 20 Hz); 2) at least a minimum increment (e.g., +/−3.75 Hz) from the immediately previous frequency, and 3) at least a minimum increment (e.g., +/−1.5 Hz) from any of the past two (or three) frequencies. Of course, more or fewer rules, as well as completely different rules, can be used to randomly select a frequency.

A random, rule-based, methodology need not be applied in real-time during engine operation. For example, such an approach can be used to generate sequences that can be tested to identify a sequence that minimizes consecutive alignments between on-pulses and the intake strokes of a single cylinder. Sequences identified as preventing consecutive alignments can then be implemented as predetermined sequences, which are fixed before engine operation begins.

Figure 9:
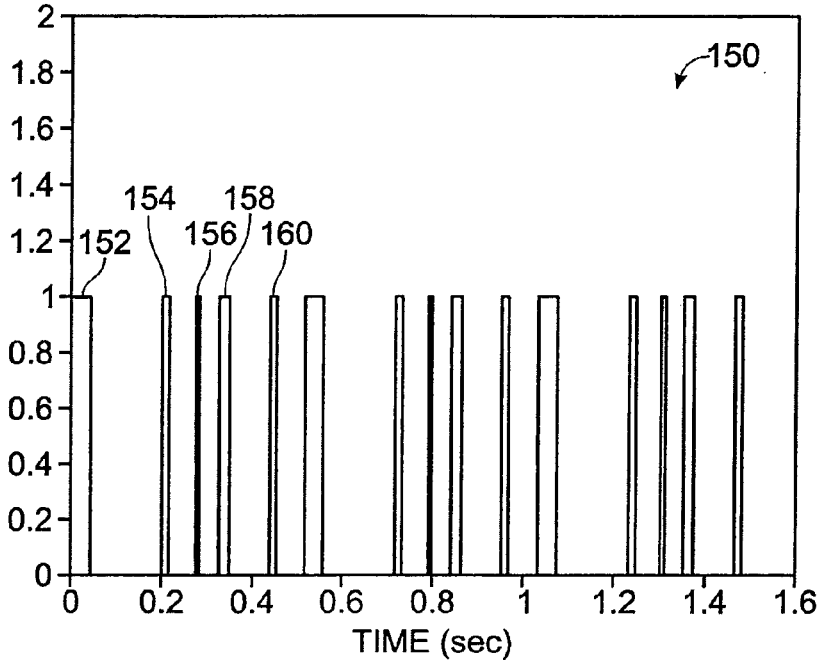
FIG. 9 shows an example of a predetermined fixed schedule of purge control valve on frequencies.

FIG. 9 shows a predetermined schedule 150, in which the on-pulse frequency of a purge control valve changes. In the illustrated example, the frequency changes according to a repeating sequence, where the frequency changes from 5 Hz at 152 to 14 Hz at 154 to 20 Hz at 156 to 8.75 Hz at 158 to 12.5 Hz at 160, and then back to 5 Hz and so on. In other words, the signal period is 200 msec. at 152, 71.4 msec. at 154, 50 msec. at 156, 114.3 msec. at 158, and 80 msec. at 160. The above example has five distinct frequency values, which are repeated over and over without regard to engine speed, elapsed time, or other operating parameters of the engine. In some embodiments, more or fewer than five distinct frequency values may comprise a sequence (e.g., (20 Hz, 7.5 Hz, 16.25 Hz, 11 Hz, 5.75 Hz, 13 Hz) or (6 Hz, 19 Hz, 11 Hz)). In some embodiments, a sequence may have one or more values that repeat within the sequence (e.g., 5 Hz, 18 Hz, 9 Hz, 5 Hz, 12 Hz, 17 Hz). It should be understood that these are a few of many possible sequences. The examples provided herein are nonlimiting, and other sequences can be used while remaining within the scope of this disclosure.

In some embodiments, the duty cycle of the purge control valve can be configured to remain substantially constant (e.g., when desired purge flow and pressure difference across the valve are constant in order to produce a constant average purge flow), even though the on-pulse frequency is changing. For example, the duty cycle of the purge control valve signal illustrated in FIG. 9 is set to remain constant at about 20%. In order to maintain a substantially constant duty cycle, the pulse duration (sometimes referred to as pulse width) decreases as on-pulse frequency increases. For example, at time zero the frequency is 5 Hz, which corresponds to a period of 200 msec. The on-pulse can be seen starting at time zero and lasting for 40 msec, which is 20% of the period (duty cycle is 20% in this case). The second on-pulse starts at time 200 msec (0.2 sec), which is when the last signal period ended. The second signal period is 71 msec, and the on-pulse duration is 14 msec, which corresponds to the second frequency value in the sequence, 14 Hz. The third signal period is 50 msec, and the on-pulse duration is 10 msec, which corresponds to the third frequency value in the sequence, 20 Hz. The fourth signal period is 114 msec, and the on-pulse duration is 23 msec, which corresponds to the fourth frequency value in the sequence, 8.75 Hz. The fifth signal period is 80 msec, and the on-pulse duration is 16 msec, which corresponds to the fifth frequency value in the sequence, 12.5 Hz. When the fifth signal period ends, the frequency moves back to the first value of the sequence, 5 Hz. This repeating pattern of frequencies continues as long as the engine is running. The on-pulse widths can be larger for higher commanded duty cycles and smaller for lower commanded duty cycles.

Although not necessarily required in every embodiment, the schedule illustrated in FIG. 9 exemplifies the principles that 1) the magnitude of consecutive frequencies should not be close to one another, and 2) a frequency that is changed should not be changed again to near the same frequency for at least two cycles.

Figure 10:
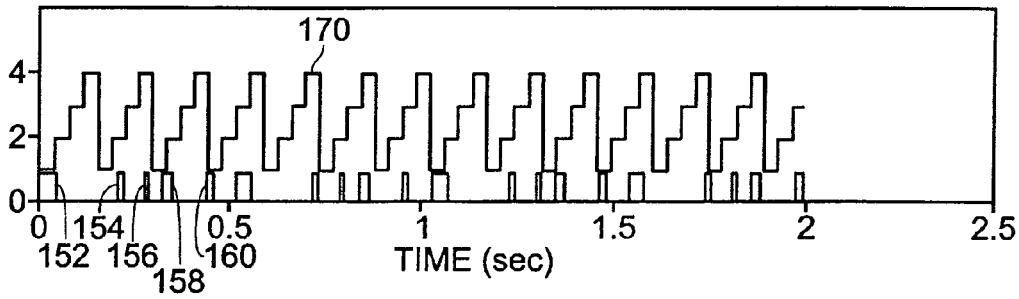
FIG. 10 is a timing chart showing the predetermined fixed schedule of FIG. 9 in relation to intake stroke timing in a four cylinder engine operating at 820 rpm.
Figure 11:
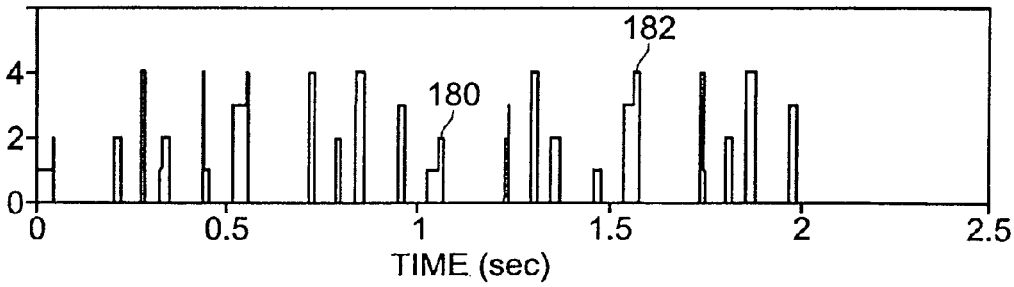
FIG. 11 shows cylinder to purge control valve alignment for a four cylinder engine operating at 820 rpm and a purge control valve operating according to the predetermined fixed schedule of FIG. 9.

FIG. 10 shows the data from FIG. 9 plotted below intake stroke timing 170 in an exemplary four cylinder engine operating at 820 rpm. FIG. 11 shows which cylinder currently has an intake stroke that is aligned with the purge valve on-pulse. It can be seen from FIG. 11 that there are no consecutive alignments of on-pulses with the same cylinder, except for some shared alignments, where the on-pulse is shared between two cylinders (e.g., at 180 where the on-pulse is shared by cylinders 1 and 2, or at 182 where the on-pulse is shared by cylinders 3 and 4). This alignment prevention method works for all known practicable engine speeds. The sequence of frequencies does not need to change as engine speed changes or for any other reason.

Figure 12:
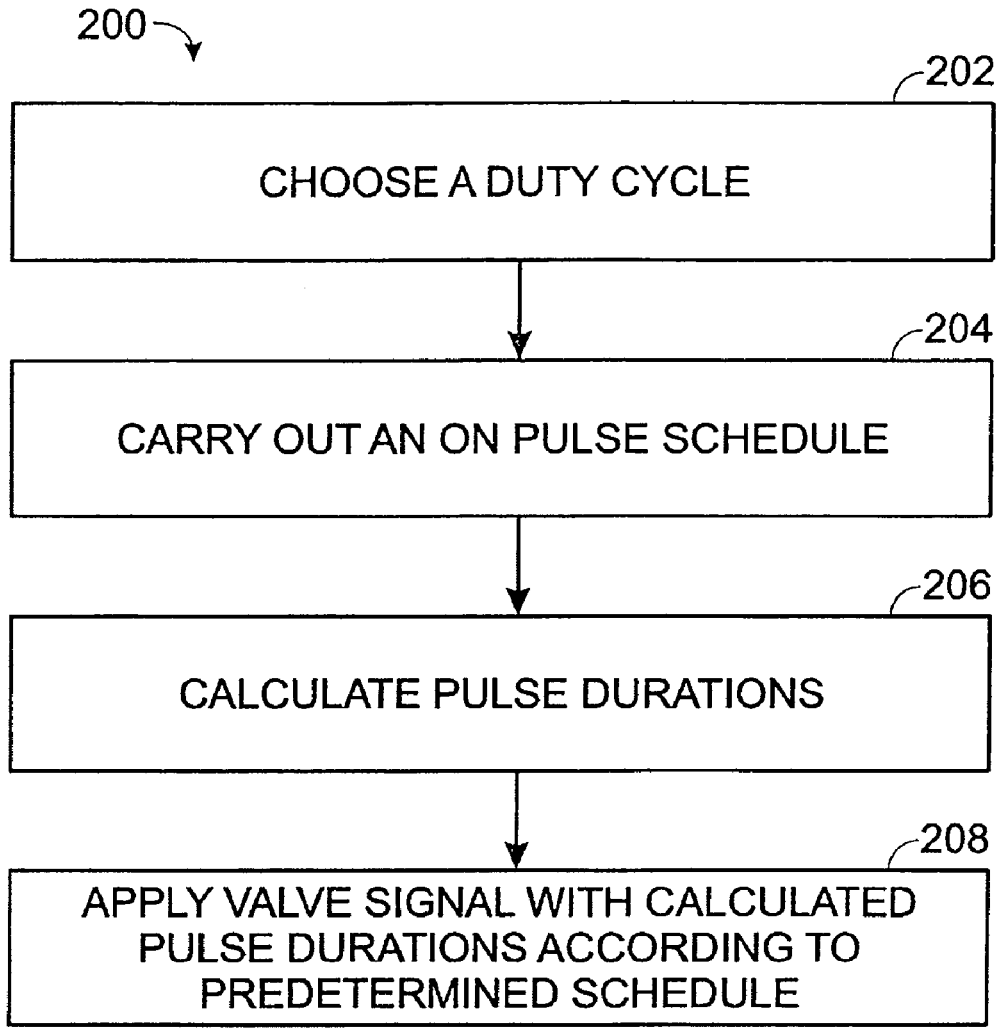
FIG. 12 is a flow chart showing an example method of controlling a pulse-width-modulated valve.

FIG. 12 is a flowchart showing one exemplary method 200 of controlling a pulse-width-modulated valve, such as a purge control valve of a vehicle having an internal combustion engine. Method 200 includes, at 202, choosing a duty cycle. In some embodiments, the duty cycle can be a constant duty cycle, and in some embodiments the duty cycle can be a variable duty cycle. Choosing a duty cycle can include using a lookup table to determine what duty cycle is needed to produce a desired purge flow rate at the current value of pressure difference across the purge valve, for example. At 204, method 200 includes carrying out a predetermined an on-pulse schedule. As described above with reference to a purge control valve, the on-pulse schedule can be a repeating set of frequencies. In some embodiments, successive frequencies can be no closer than 3.75 Hz (or another minimum value) from one another. At 206, on-pulse duration is calculated so that each on-pulse can be applied with a duration corresponding to a matched frequency, so that the chosen duty cycle is achieved as the frequency is continually cycled through the chosen schedule. As shown at 208, the valve signal with the calculated pulse duration can be applied to a pulse-width-modulated valve according to the predetermined schedule.

The invention claimed is:

1. A purge control system, comprising:

a passage configured to allow purge fuel vapor to flow therethrough;

a valve element selectively switchable between at least an on position and an off position, where the valve element allows flow of purge fuel vapor through the passage in the on position, and where the valve element blocks flow of purge fuel vapor through the passage in the off position; and a controller configured to switch the valve element between the on position and the off position according to a fixed schedule in which a frequency of successive on positions changes.

2. The purge control system of claim 1, where the fixed schedule includes a repeating sequence.

3. The purge control system of claim 2, where the repeating sequence is 5 Hz to 14 Hz to 20 Hz to 8.75 Hz to 12.5 Hz back to 5 Hz.

4. The purge control system of claim 1, where the fixed schedule is randomly generated within the constraint of at least one rule.

5. The purge control system of claim 1, where the frequency of successive on positions changes by at least +/−3 Hz.

6. The purge control system of claim 1, where the frequency of every on-pulse is different from at least two immediately preceding on-pulses.

7. The purge control system of claim 1, where a duration of the on position is modulated to maintain a substantially constant duty cycle as the frequency of successive on positions changes.

8. The purge control system of claim 1, where, during at least some engine operating conditions, a table or calculation is used to modulate a duration of the on position, as a frequency of successive on positions changes, to produce a desired purge flow at a current pressure difference across the purge valve.

9. A method of controlling on and off timing in a purge control valve configured to alternate between an on position and an off position, the method comprising:

predetermining a fixed schedule of successive frequencies for switching between the on position and the off position, where all frequencies of the fixed schedule are different from immediately preceding and following frequencies.

10. The method of claim 9, where the frequency for switching between the on position and the off position changes every time the valve is switched from the off position to the on position.

11. The method of claim 9, where the fixed schedule includes a repeating sequence of frequencies at which the valve is switched between the on position and the off position.

12. The method of claim 11, where the repeating sequence is 5 Hz to 14 Hz to 20 Hz to 8.75 Hz to 12.5 Hz back to 5 Hz.

13. The method of claim 9, where all frequencies of the schedule are at least +/3 Hz different from immediately preceding and following frequencies.

14. The method of claim 9, where the fixed schedule does not repeat the same frequency for at least two frequency changes.

15. The method of claim 9, where the fixed schedule further defines a duration for each on position, where the duration is modulated to maintain a substantially constant duty cycle as the frequency for switching between the on position and the off position changes.

16. The method of claim 9, where the fixed schedule further defines a duration for each on position, where the duration is modulated, using a table or calculation as the frequency for switching between the on position and the off position changes, to produce a duty cycle that produces a desired purge flow at a current value of pressure difference across the purge valve.

17. The method of claim 10, further comprising, opening and closing the purge control valve, during engine operation, according to the predetermined fixed schedule.

18. A method for controlling a valve, comprising:

choosing a duty cycle;

carrying out a repeating sequence of changing on-pulse frequencies;

calculating, for each on-pulse frequency in the repeating sequence, a pulse duration for that on-pulse frequency that yields the chosen duty cycle; and applying to the valve a signal that modulates according to the predetermined repeating sequence of on-pulse frequencies and the calculated on-pulse durations.

19. The method of claim 18, where the repeating sequence is 5 Hz to 14 Hz to 20 Hz to 8.75 Hz to 12.5 Hz back to 5 Hz.

20. The method of claim 18, where each frequency in the repeating sequence changes by at least +/−3 Hz from an immediately preceding frequency.

21. The method of claim 18, where a frequency is not repeated in any three consecutive frequencies of the repeating sequence.

22. The method of claim 18, where choosing a duty cycle includes choosing a substantially constant duty cycle.

23. The method of claim 18, where choosing a duty cycle includes using a table or calculation to determine a duty cycle that produces a desired purge flow at a current pressure difference across the purge valve.

* * * * *